US008961869B2

(12) United States Patent
Kapoor et al.

(10) Patent No.: US 8,961,869 B2
(45) Date of Patent: Feb. 24, 2015

(54) HARDFACING ALLOY

(75) Inventors: Ashish Kapoor, Highland Heights, OH (US); Teresa Melfi, Kirtland, OH (US)

(73) Assignee: Lincoln Global, Inc., City of Industry, CA (US)

( * ) Notice: Subject to any disclaimer, the term of this patent is extended or adjusted under 35 U.S.C. 154(b) by 2214 days.

(21) Appl. No.: 11/041,815

(22) Filed: Jan. 24, 2005

(65) Prior Publication Data

US 2006/0165551 A1 Jul. 27, 2006

(51) Int. Cl.
*C22C 38/24* (2006.01)
*C22C 38/26* (2006.01)

(52) U.S. Cl.
CPC ..... *C22C 38/24* (2013.01); *C22C 38/26* (2013.01)
USPC ..... 420/34; 148/325

(58) Field of Classification Search
CPC ..... B23K 35/0261
USPC ..... 420/34, 67, 69; 148/325
See application file for complete search history.

(56) References Cited

U.S. PATENT DOCUMENTS 4,091,253 A * 5/1978 Bagshaw et al. ..... 219/76.14
6,331,688 B1 12/2001 Hallen et al.
6,835,913 B2 12/2004 Duncan et al.
7,270,719 B2 9/2007 Berglund
2004/0173592 A1 9/2004 Duncan
2006/0081579 A1 4/2006 Kotecki

FOREIGN PATENT DOCUMENTS

CA 2463688 A1 * 4/2003
EP 1647351 4/2006
JP 06287717 A * 10/1994
JP 8224691 3/1996

OTHER PUBLICATIONS

English Translation of Ikegami et al., JP 06-287717, Oct. 11, 1994, p. 1-10.*
NPL: Hardness Conversion Table, http://www.gordonengland.co.uk/hardness/hardness_conversion_2m.htm, downloaded on 2007.*
Tribology International Erosive Wear Behaviour of Weld Hardfacing High Chromium Cast Irons: Effect of Erodent Particles—Feb. 2005 Retrieved from the Internet—www.sciencedirect.com.
H. Berns, A. Fischer: Microstructure of Fe—Cr—C hardfacing alloys with additions of Nb, Ti and B. Metallography, vol. 20, No. 4, Nov. 1987 pp. 401-429.
Fan et al.—Microstructure change caused by (Cr, Fe) 23C6 carbides in high chromium Fe—Cr—C hardfacing alloys. Surface and coatings technology, Elsevier, vol. 201, No. 3-4. Oct. 5, 2006.

* cited by examiner

*Primary Examiner* — Jie Yang
(74) *Attorney, Agent, or Firm* — Hahn Loeser & Parks LLP

(57) ABSTRACT

A hardfacing alloy for use as a surfacing on metal that are subjected to high thermal and mechanical stresses. The hardfacing alloy includes at least about 7 weight percent chromium, at least about 0.02 weight percent nitrogen, metal sensitization inhibitor, and a majority weight percent iron. The hardfacing alloy includes a low percentage of ferrite.

2 Claims, No Drawings

HARDFACING ALLOY

The invention relates generally to the field of metal alloys and more particularly directed to a hardfacing metal alloy.

BACKGROUND OF THE INVENTION

"Hardfacing" is a technique which involves applying a layer of hard material to a substrate for the purpose of increasing the wear and corrosion resistance of the substrate. The use of this technique has increased significantly over the years as industry has come to recognize that substrates of softer, lower cost material can be hardfaced to have the same wear and corrosion-resistance characteristics as more expensive substrates of a harder material.

Hardfacing involves the deposition of a hard layer by welding or thermal spraying. Conventional weld hardfacing is accomplished by oxyfuel welding (OFW), gas tungsten arc welding (TIG), gas metal arc welding (GMAW), shielded metal arc welding (SMAW), flux-cored arc welding (FCAW), submerged arc welding (SAW), electroslag cladding, spray cladding and the like. Plasma transferred arc (PTA) hardfacing and laser beam hardfacing can also be used.

Most prior art hardfacing materials harder than siliceous earth materials are brittle and crack. These hardfacing materials are alloys which belong to a well-known group of "high Cr-irons" and their high abrasive resistance is derived from the presence in the microstructure of the Cr-carbides of the eutectic and/or hypereutectic type. In the as-welded condition, whatever the precautions taken, these hardfacing overlays always show a more or less dense network of cracks.

It would be highly desirable and advantageous to provide a hardfacing alloy composition having a microstructure that has high abrasive resistance and corrosive resistance, and is also capable of being weld deposited without cracks to withstand the conditions of use. Furthermore, it is desirable to form a high chromium welding metal alloy system for use as a hardfacing surfacing on metals components that are subjected to high thermal and mechanical stresses.

SUMMARY OF THE INVENTION

The present invention pertains to hardfacing alloys, and more particularly, a high chromium welding metal alloy system. The hardfacing alloy is particularly useful for use as a metal surfacing on materials subjected to high thermal and mechanical stresses such as, but not limited to, steel mill caster rolls. The high chromium welding metal alloy system includes a low ferrite content in the hardfacing alloy matrix. The low ferrite content reduces the tendency of "fire cracking" in the hardfacing alloy. "Fire cracking" limits the life of a metal component that is coated or surfaced with conventional alloy systems. Typically the ferrite content of the hardfacing alloy is less than about 10%, and more typically less than about 5%, and even more typically less than about 3%, still even more typically less than about 2%, still yet even more typically less than about 1%, and still yet even more typically less than about 0.5%. The hardfacing alloy of the present invention can be welded to a surface using the following products and processes, under various types of gas (e.g., $CO_2$, Argon, $CO_2$-Argon mixture, etc.), self shielded (open arc) tubular wire and submerged-arc electrode. As such, the hardfacing alloy deposit of the present invention can be formed by several welding processes such as, but not limited to, neutral SAW flux with alloyed cored/solid electrode, alloyed SAW flux with alloyed cored/solid electrode, alloyed SAW flux with unalloyed cored/solid electrode, the cored electrode itself can have a combination of alloyed/unalloyed sheath and alloyed/unalloyed fill. The hardfacing alloy has a hardness in the range of about 25-64 RC (welded or tempered), and an ASTM G-65 wear rating in the range of about 1-3 g.

The hardfacing alloy of the present invention has a unique combination of chromium; nitrogen; and niobium and/or vanadium. Typically, the hardfacing alloy includes at least about 7% chromium; at least about 0.02% nitrogen; and at least about 0.3% niobium and/or at least about 0.05% vanadium. In addition, the hardfacing alloy typically includes at least a majority of iron.

In one non-limiting example, the hardfacing alloy includes, by weight:

| | |
|---|---|
| Cr | 8-20% |
| N | 0.03-0.3% |
| Nb | 0.4-2.5% |
| V | 0.08-0.5% |

In another non-limiting example, the hardfacing alloy includes, by weight:

| | |
|---|---|
| C | 0.05-0.3% |
| Cr | 10-18% |
| Mn | 0.5-5% |
| Mo | 0.2-4% |
| N | 0.05-0.25% |
| Nb | 0.5-2% |
| Ni | 1-9% |
| V | 0.1-0.4% |
| Fe | 60-88% |

In still another non-limiting example, the hardfacing alloy includes, by weight:

| | |
|---|---|
| Al | 0-0.05% |
| C | 0.1-0.2% |
| Co | 0-0.05% |
| Cr | 10-15% |
| Cu | 0-0.1% |
| Mn | 1-3% |
| Mo | 0.5-2% |
| N | 0.05-0.2% |
| Nb | 0.5-1.5% |
| Ni | 3-6% |
| P | 0-0.02% |
| S | 0-0.02% |
| Si | 0-1.5% |
| Ta | 0-0.02% |
| Ti | 0-0.01% |
| V | 0.1-0.3% |
| Fe | 65-85% |

It is an object of the present invention to provide a hardfacing alloy for use on material subjected to high thermal and mechanical stresses to thereby increase the life of such materials.

It is another and/or alternative object of the present invention to provide a hardfacing alloy that reduces the tendency of "fire cracking."

It is still another and/or alternative object of the present invention to provide a hardfacing alloy having a low ferrite content in the deposit.

It is yet another and/or alternative object of the present invention to provide a hardfacing alloy that reduces sensitization of the alloy during thermal cycling.

These and other objects and advantages will become apparent from the discussion of the distinction between the invention and the prior art.

DETAILED DESCRIPTION OF THE INVENTION

Referring to the following description of the invention for purposes of describing preferred embodiments of the invention only, and not for the purpose of limiting the invention, the composition of the hardfacing alloy of the present invention has an average hardness of about 25-65 in either the welded state or the tempered state. The hardfacing alloy is particularly formulated to form a high chromium welding metal alloy system for use as a surfacing on metals subjected to high thermal and mechanical stresses. One such application is to apply the hardfacing alloy to steel mill caster rolls; however, it will be appreciated that the hardfacing alloy can be used in other applications. The hardfacing alloy is also formulated to resist the tendency for "fire cracking", thereby extending the life of metal materials that are surfaced with the hardfacing alloy of the present invention. The hardfacing alloy is also formulated so as to reduce the amount of ferrite in the alloy matrix. Typically the hardfacing alloy includes less than about 6%, more typically about 4% ferrite, even more particularly less than about 2% ferrite, and still even more particularly less than about 1% ferrite. The hardfacing alloy is further formulated to reduce sensitization of the alloy which can occur during thermal cycling.

The hardfacing alloy composition can be deposited by any suitable welding means and methods such as, but not limited to, open arc, gas or flux shielded. The welding electrode can be a solid wire, cored electrode, coated electrode or coated cored electrode. When the electrode is a coated and/or cored electrode, the coating and/or fill material in the core can include alloying agents, fluxing agents, slag agents, gas generating agents, etc. The electrode can be a self shielding electrode and/or be used in the presence of a shielding gas. The hardfacing alloy can also be applied by directly depositing the metal particles on the workpiece and/or can be spray coated on the workpiece. As such, the hardfacing alloy can be applied by a variety of processes such as, but not limited to, submerged arc welding (SAW), shielded metal arc welding (SMAW), flux-cored arc welding (FCAW), gas metal arc welding (GMAW), gas tungsten arc welding (TIG), metal spraying, etc.

The chemical analysis of one embodiment of the hardfacing alloy by weight percent is set forth below:

| | |
|---|---|
| C | 0.1-0.2% |
| Cr | 10-15% |
| Mn | 1-3% |
| Mo | 0.5-2% |
| N | 0.05-0.2% |
| Nb | 0.5-1.5% |
| Ni | 3-6% |
| V | 0.1-0.3% |
| Fe | 65-85% |

The believed functions of each of these components of the hardfacing alloy will be described; however, it will be appreciated that these are only the believed functions of the components, thus the components could have other or additional functions in the hardfacing alloy. The carbon in the hardfacing alloy is believed to influence the hardness level of the hardfacing alloy and to also influence the ferrite content of the hardfacing alloy. Generally the carbon content of the hardfacing alloy is at least about 0.04 weight percent of the hardfacing alloy and less than about 0.35 weight percent. The chromium in the hardfacing alloy is believed to affect the corrosion resistance of the hardfacing alloy and to also influence the ferrite content of the hardfacing alloy. Generally the chromium content of the hardfacing alloy is at least about 7 weight percent of the hardfacing alloy and less than about 25 weight percent. The manganese in the hardfacing alloy is believed to function as a deoxidizer and to also reduce or prevent hot cracking of the hardfacing alloy. Generally the manganese content of the hardfacing alloy is at least about 0.4 weight percent of the hardfacing alloy and less than about 6 weight percent. The molybdenum in the hardfacing alloy is believed to affect the corrosion resistance of the hardfacing alloy and to also affect the ferrite content of the hardfacing alloy. Generally the molybdenum content of the hardfacing alloy is at least about 0.15 weight percent of the hardfacing alloy and less than about 4.5 weight percent. The nitrogen in the hardfacing alloy is believed to reduce or prevent sensitization of the hardfacing alloy. Generally the nitrogen content of the hardfacing alloy is at least about 0.02 weight percent of the hardfacing alloy and less than about 0.35 weight percent. The niobium in the hardfacing alloy is believed to increase the resistance of the hardfacing alloy to tempering and to also inhibit or prevent sensitization of the hardfacing alloy. Generally the niobium content of the hardfacing alloy is at least about 0.3 weight percent of the hardfacing alloy and less than about 3 weight percent. The nickel in the hardfacing alloy is believed to affect the corrosion resistance of the hardfacing alloy; affect the strength, toughness and ductility of the hardfacing alloy; and to also affect the ferrite content of the hardfacing alloy. Generally the nickel content of the hardfacing alloy is at least about 0.5 weight percent of the hardfacing alloy and less than about 10 weight percent. The vanadium in the hardfacing alloy is believed to increase the resistance of the hardfacing alloy to tempering and to also inhibit or prevent sensitization of the hardfacing alloy. Generally the vanadium content of the hardfacing alloy is at least about 0.05 weight percent of the hardfacing alloy and less than about 0.6 weight percent.

The hardfacing alloy can include one or more other components such as, but not limited to, aluminum, silicon and/or titanium. The aluminum, when included in the hardfacing alloy, is believed to affect the ferrite content in the hardfacing alloy. Generally the aluminum content of the hardfacing alloy is less than about 0.2 weight percent. The silicon, when included in the hardfacing alloy, is believed to function as a deoxidizer for the hardfacing alloy. Generally the silicon content of the hardfacing alloy is less than about 2 weight percent. The titanium, when included in the hardfacing alloy, is believed to affect the ferrite content in the hardfacing alloy. Generally the titanium content of the hardfacing alloy is less than about 0.1 weight percent.

The chemical analysis of one non-limiting example of the hardfacing alloy by weight percent is set forth below:

| | |
|---|---|
| Al | 0-0.05% |
| C | 0.1-0.15% |
| Co | 0-0.05% |
| Cr | 10.5-13.5% |
| Cu | 0-0.1% |
| Mn | 1-1.8% |
| Mo | 0.6-1.4% |
| N | 0.06-0.12% |
| Nb | 0.5-1% |
| Ni | 3.5-5% |
| P | 0-0.02% |
| S | 0-0.02% |

-continued

| | |
|---|---|
| Si | 0.5-1.5% |
| Ta | 0-0.02% |
| Ti | 0-0.01% |
| V | 0.12-0.25% |
| Fe | 74-84% |

These and other modifications of the discussed embodiments, as well as other embodiments of the invention, will be obvious and suggested to those skilled in the art from the disclosure herein, whereby it is to be distinctly understood that the foregoing descriptive matter is to be interpreted merely as illustrative of the present invention and not as a limitation thereof.

We claim:

1. A hardfacing alloy for application to a metal surface having a hardness of about 25-65 RC and a wear rating of about 1-3 g ASTM G-65, said hardfacing alloy consisting of by weight percent:

| | |
|---|---|
| C | 0.05-0.3%; |
| Cr | 10-18%; |
| Mn | 0.5-5%; |

-continued

| | |
|---|---|
| Mo | 0.2-4%; |
| N | 0.05-0.25%; |
| Nb | over 0.5 and up to 2%; |
| Ni | 1-9%; |
| V | 0.1-0.4%; and |
| Fe | 60-88%. |

2. A hardfacing alloy for application to a metal surface having a hardness of about 25-65 RC and a wear rating of about 1-3 g ASTM G-65, said hardfacing alloy consisting of by weight percent:

| | |
|---|---|
| C | 0.1-0.2% |
| Cr | 10-15% |
| Mn | 1-3% |
| Mo | 0.5-2% |
| N | 0.05-0.2% |
| Nb | over 0.5 and up to 1.5% |
| Ni | 3-6% |
| V | 0.1-0.3%; and |
| Fe | 65-85% |

* * * * *